US006733355B2

(12) United States Patent
Hwang et al.

(10) Patent No.: US 6,733,355 B2
(45) Date of Patent: May 11, 2004

(54) MANUFACTURING METHOD FOR TRIODE FIELD EMISSION DISPLAY

(75) Inventors: Seong-Yeon Hwang, Suwon (KR); Sang-Jin Lee, Suwon (KR); Jong-Min Kim, Seongnam (KR)

(73) Assignee: Samsung SDI Co., Ltd., Suwon (KR)

( * ) Notice: Subject to any disclaimer, the term of this patent is extended or adjusted under 35 U.S.C. 154(b) by 8 days.

(21) Appl. No.: 10/247,588

(22) Filed: Sep. 20, 2002

(65) Prior Publication Data

US 2003/0082983 A1 May 1, 2003

(30) Foreign Application Priority Data

Oct. 25, 2001 (KR) ..... 2001-66101
Nov. 30, 2001 (KR) ..... 2001-75566

(51) Int. Cl.[7] ..... H01J 9/00; H01J 9/02; H01J 9/18

(52) U.S. Cl. ..... 445/24; 445/49; 445/50; 445/51; 430/311; 430/314

(58) Field of Search ..... 445/24, 49, 50, 445/51; 430/311, 312, 314, 321

(56) References Cited

U.S. PATENT DOCUMENTS 5,053,673 A * 10/1991 Tomii et al. ..... 445/24
5,320,570 A * 6/1994 Kane ..... 445/50
5,529,524 A * 6/1996 Jones ..... 445/24
5,551,903 A * 9/1996 Kumar et al. ..... 445/24
5,614,353 A * 3/1997 Kumar et al. ..... 430/313
5,827,100 A * 10/1998 Kim ..... 445/50

* cited by examiner

*Primary Examiner*—Kenneth J. Ramsey
*Assistant Examiner*—Mariceli Santiago
(74) *Attorney, Agent, or Firm*—McGuireWoods LLP

(57) ABSTRACT

The present invention provides a method for manufacturing a triode field emission display (FED) that can accommodate a large screen size and that has holes that are minutely and uniformly formed. The method includes forming cathode electrodes on a first substrate; depositing a photosensitive material on the first substrate covering the cathode electrodes; patterning the photosensitive material in a predetermined pattern to form guide supports for the formation of insulation layer holes at locations where an electron emitting layer will be formed on the cathode electrodes; forming a preliminary insulation layer on the first substrate covering the guide supports; removing the guide supports from the cathode electrodes to form holes at the locations of the guide supports, thereby realizing a completed insulation layer from the preliminary insulation layer; forming gate electrodes on the insulation layer, the gate electrodes having holes corresponding to the holes of the insulation layer; forming an electron emitting layer on the cathode electrodes; providing a second substrate with anode electrodes and a phosphor layer formed thereon, substantially in parallel to the first substrate, and connecting and sealing the first and second substrates to realize a sealed assembly; and exhausting air from within the sealed assembly.

11 Claims, 9 Drawing Sheets

MANUFACTURING METHOD FOR TRIODE FIELD EMISSION DISPLAY

FIELD OF THE INVENTION

The present invention relates to a manufacturing method for a triode field emission display, and more particularly, to a manufacturing method for a triode field emission display, in which the field emission display provides a large screen size and has holes that are minutely and uniformly formed.

BACKGROUND OF THE INVENTION

In the first field emission displays (FEDs), conical metal microtips were formed on cathode electrodes, and gate electrodes were formed in peripheries of the metal microtips. With such a structure, electrons emitted from the metal microtips are accelerated toward a phosphor layer provided on anode electrodes to thereby realize images. However, a drawback of this configuration is that expensive semiconductor equipment is needed to form the metal microtips (i.e., an electron-emitting layer). This increases overall manufacturing costs and makes the production of display devices of a large screen size difficult.

To remedy this problem, there has been disclosed an FED with a surface electron source structure, in which the electron emitting layer is formed as a film. Such a surface-type electron emitting layer is realized using a conventional carbon-based material. In recent times, much attention has been given to a carbon nanotube structure. Carbon nanotubes have the advantages of a minute curvature radius at their tips of approximately 100. and are capable of realizing smooth electron emission at driving voltages of approximately 10.50V. Accordingly, carbon nanotubes enable operation at low voltages, and are an ideal electron emitting source for FEDs with large screen sizes.

FEDs that use carbon nanotubes as the electron emitting source generally employ a triode structure having gate electrodes. In such FEDs, an insulation layer and gate electrodes are provided on cathode electrodes, holes are formed to expose the cathode electrodes through the insulation layer and gate electrodes, then a carbon nanotube electron emitting layer is formed within the holes and on the cathode electrodes.

In the above processes, the insulation layer having the holes may be formed by a thin film process such as the PECVD (plasma enhanced chemical vapor deposition) process or by a thick film process using paste printing. However, problems result in either of the two types of processes that interfere with the manufacture of the triode FED.

In particular, when forming the insulation layer using the thin film process, although it is possible to obtain a film having superior insulating characteristics, it is difficult to realize a sufficient thickness for the film, that is, a thickness at least matching that of the electron emitting layer. Further, even if an adequate thickness for the insulation layer is realized using the thin film process, the time required for the process is long, it is necessary to control the stresses within the film, and a complicated etching process is required to make the thick film uniform when forming the holes.

In the case where the insulation layer is formed using the thick film printing process, although it is easy to realize a desired thickness, there are difficulties in making the holes uniform and adequately minute as a result of the inherent characteristics of the printing method. When forming the holes in the insulation layer using the printing process, it is possible to realize an insulation layer having holes using only the printing process, and also to form the holes by an etching process after the insulation layer is printed and sintered. However, in either of the two printing processes to form the holes in the insulting layer, again it is possible to realize a desired thickness for the insulating but difficult to form the holes to a minute size.

SUMMARY OF THE INVENTION

It is one object of the present invention to provide a manufacturing method for a triode FED that enables the formation of an insulation layer provided between cathode electrodes and gate electrodes to a desired thickness, as well as the formation of holes in the insulation layer that are both uniform and minute.

In one embodiment, the present invention provides a method for manufacturing a triode FED comprising forming cathode electrodes on a first substrate; depositing a photosensitive material on the first substrate covering the cathode electrodes; patterning the photosensitive material in a predetermined pattern to form guide supports for the formation of insulation layer holes at locations where an electron emitting layer will be formed on the cathode electrodes; forming a preliminary insulation layer on the first substrate covering the guide supports; removing the guide supports from the cathode electrodes to form holes at the locations of the guide supports, thereby realizing a completed insulation layer from the preliminary insulation layer; forming gate electrodes on the insulation layer, the gate electrodes having holes corresponding to the holes of the insulation layer; forming an electron emitting layer on the cathode electrodes; providing a second substrate with anode electrodes and a phosphor layer formed thereon, substantially in parallel to the first substrate, and connecting and sealing the first and second substrates to realize a sealed assembly; and exhausting air from within the sealed assembly.

According to a feature of an embodiment of the present invention, the photosensitive material is selected from the group consisting of a DFR (dry film resist) film, polyimide, an emulsion, and a photoresist.

According to another feature of an embodiment of the present invention, the preliminary insulation layer is formed by using a printing process to deposit and dry an insulation paste on the first substrate covering the guide supports.

According to yet another feature of an embodiment of the present invention, the guide supports for the formation of insulation layer holes are formed by forming holes in the photosensitive material in a predetermined pattern using a photolithography process, and performing a plating process within the holes to form a plating layer therein, then removing the photosensitive material from the first substrate to thereby realize metal supports by the plating layer.

According to still yet another feature of an embodiment of the present invention, the removal of the guide supports is realized by removing an upper portion of the preliminary insulation layer to expose an upper end of the guide supports, and removing the guide supports by using one of a chemical etching process and an electrolysis process.

According to still yet another feature of an embodiment of the present invention, the guide supports for the formation of insulation layer holes are formed by patterning the photosensitive material using a photolithography process to thereby realize photosensitive supports obtained by the photosensitive material at locations where an electron emitting layer will be formed.

According to still yet another feature of an embodiment of the present invention, the exposure performed by the photolithography process is effected from a side of the first substrate opposite that on which the cathode electrodes are formed.

According to still yet another feature of an embodiment of the present invention, the removal of the guide supports is realized by sintering the preliminary insulation layer and removing portions of the preliminary insulation layer corresponding to positions of the guide supports.

According to still yet another feature of an embodiment of the present invention, the sintering is performed by maintaining a temperature that exceeds a softening point of an insulation frit by 20–30, for 5–60 minutes.

According to still yet another feature of an embodiment of the present invention, the preliminary insulation layer is formed by a process selected from the group consisting of a printing process, a cataphoresis process, a doctor blade process, and a spray process.

BRIEF DESCRIPTION OF THE DRAWINGS

The accompanying drawings, which are incorporated in and constitute a part of the specification, illustrate an embodiment of the invention, and, together with the description, serve to explain the principles of the invention, in which.

DETAILED DESCRIPTION OF THE PREFERRED EMBODIMENTS

Preferred embodiments of the present invention will now be described in detail with reference to the accompanying drawings.

FIGS. 1A through 1J are partially enlarged sectional views of a triode FED as it undergoes sequential processes in a manufacturing method according to a first preferred embodiment of the present invention. The drawings show the FED cut along a long axis direction.

Figure 1A:
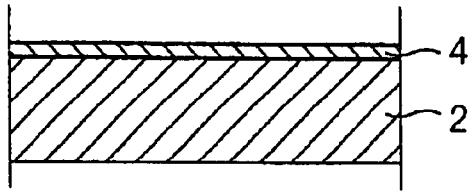
FIGS. 1A–1J show partially enlarged sectional views of a FED as it undergoes sequential processes in a manufacturing method according to a first preferred embodiment of the present invention.

First, with reference to FIG. 1A, a plurality of cathode electrodes 4 are formed in a stripe pattern on a first substrate (hereinafter referred to as a lower substrate) 2. The cathode electrodes 4 are typically made of a metal such as chrome, silver, or nickel, but may also be made of a clear material such as ITO (indium tin oxide). It is preferable that the cathode electrodes 4 are maintained at a thickness of between 1000 and 3000. The cathode electrodes 4 are formed using a thin film formation process such as sputtering or a thick film formation process such as printing, depending on the material used for the cathode electrodes 4.

Figure 1B:
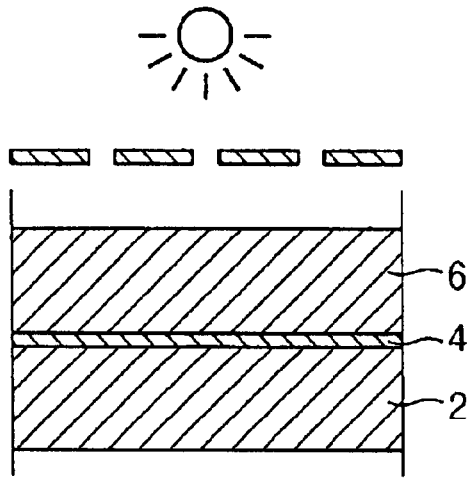

Next, with reference to FIG. 1B, a photosensitive material 6 is first deposited on the lower substrate 2 covering the cathode electrodes 4, then formed in a predetermined pattern. For the photosensitive material 6, it is possible to use a DFR (dry film resist) film, polyimide, an emulsion, or a photoresist. In the first preferred embodiment of the present invention, a DFR film is used for the photosensitive material 6.

In the first embodiment of the present invention, the photosensitive material 6 is provided on the cathode electrodes 4 then patterned thereon before the formation of an insulation layer (as with conventional FED manufacturing methods) in order to form guide supports. The guide supports enable the formation of insulation layer holes on top of the cathode electrodes 4, that is, at locations corresponding to an electron emitting layer. The guide supports are formed in the first preferred embodiment of the present invention according to the following processes.

Figure 1C:
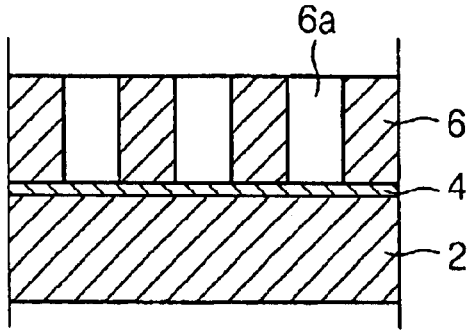

First, in a state where the photosensitive material 6 is provided at a predetermined thickness as shown in FIG. 1B, the photosensitive material 6 is exposed and developed using a photolithography process such that holes **6*a* are formed in the photosensitive material 6 in a predetermined pattern as shown in FIG. 1C**.

Figure 1D:
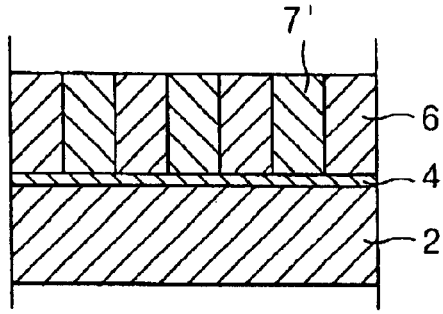
Figure 1E:
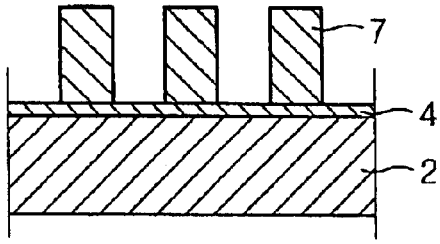

Next, a plating layer 7' is formed in the holes **6*a* using a plating process such as an electrolytic plating process or a non-electrolytic plating process as shown in FIG. 1D. After the plating layer 7' is formed, the photosensitive material 6 is removed from the lower substrate 2 such that the plating layer 7' is exposed. With the removal of the photosensitive material 6, the plating layer 7' becomes the guide supports, hereinafter indicated by reference numeral 7. The completed guide supports 7 are shown in FIG. 1E. Therefore, the guide supports 7** in the first preferred embodiment of the present invention are metal guide supports realized through a plating process.

Figure 1F:
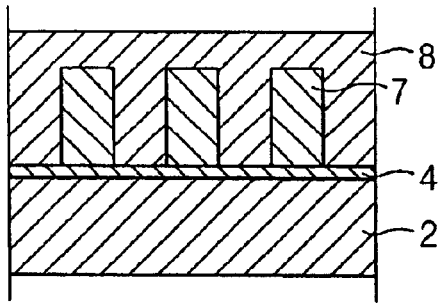

Subsequently, a preliminary insulation layer 8 is formed on the lower substrate 2 at a thickness sufficient to completely cover the guide supports 7. In the first preferred embodiment of the present invention, the preliminary insulation layer 8 is formed by a printing process. That is, an insulation paste is printed on the lower substrate 2 covering the guide supports 7, then the printed insulation paste is dried at a temperature between 90 and 120, to thereby form the preliminary insulation layer 8 as shown in FIG. 1F.

Figure 1G:
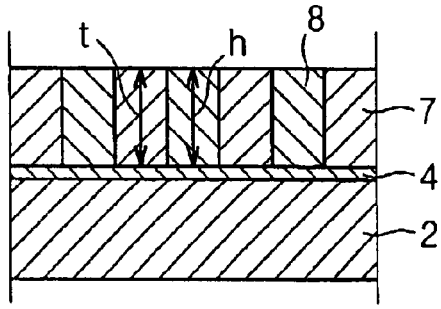

Next, an upper portion of the preliminary insulation layer 8 is removed by a grinding, sandblasting, or etching process such that upper ends of the guide supports 7 are exposed as shown in FIG. 1G. After the upper portion of the preliminary insulation layer 8 is removed, it is preferable that a thickness (t) of the preliminary insulation layer 8 and a height (h) of the guide supports 7 are identical. However, it is also possible for the thickness (t) of the preliminary insulation layer 8 and the height (h) of the guide supports 7 to be somewhat different. Sintering is then performed on the elements shown in FIG. 1G at a temperature between 400 and 550. to thereby prepare an insulating layer having a required layer quality.

Figure 1H:
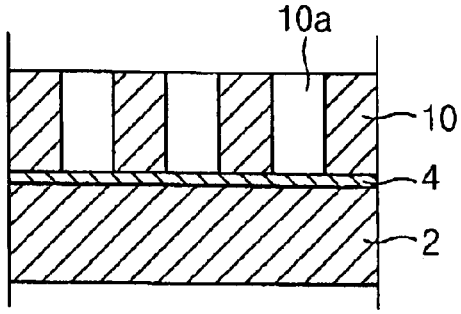

Following the above, the guide supports 7 are removed using a solution for this purpose, or through electrolysis. With the removal of the guide supports 7 from the lower substrate 2, a plurality of holes **10*a* is formed in the preliminary insulation layer 8 to thereby realize a completed insulation layer 10 as shown in FIG. 1H**.

After the insulation layer 10 is prepared through the processes described above, gate electrodes 12 are formed on an upper end of the insulation layer 10 using the same process as when forming the cathode electrodes 4. Also, a paste is printed on the cathode electrodes 4 within the holes **10*a* of the insulation layer 10 to thereby form an electron emitting layer 14 having a predetermined pattern as shown in FIG. 11**. The paste includes a carbon-based material such as carbon nanotubes, graphite, diamond, diamond-like carbon, etc.

Figure 1I:
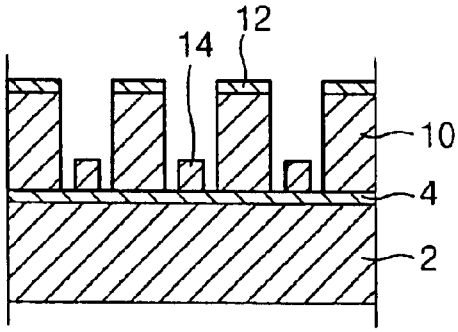
Figure 1J:
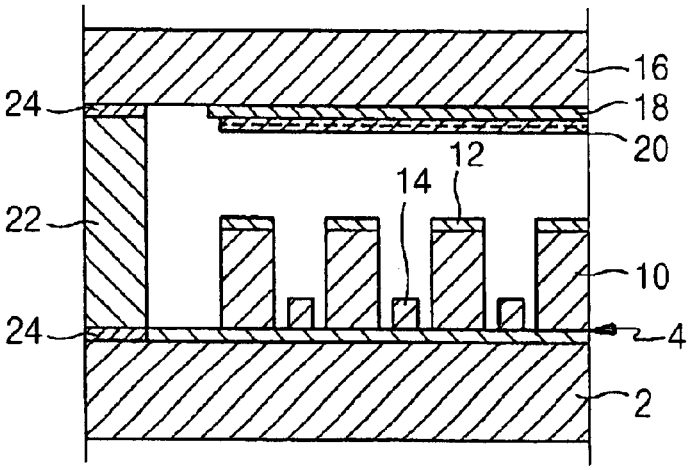

After the printing process to form the electron emitting layer 14 as shown in FIG. 1I, anode electrodes 18 and a phosphor layer 20 are formed on a second substrate (hereinafter referred to as an upper substrate) 16. A side glass 22 is then interposed between the upper substrate 16 and the lower substrate 2 so as to place the upper substrate 16 and the lower substrate 2 substantially in parallel, after which a sealant 24 is used to fuse the lower substrate 2, the upper substrate 16, and the side glass 22. As a result, a sealed assembly for the FED is realized. Finally, an exhaust unit is used to remove the air from between the substrates 2 and 16 to thereby complete the triode FED as shown in FIG. 1J.

In the FED manufactured as in the above, it is unnecessary to undergo a complicated and difficult process of etching to control the formation of the holes or thick layer printing to control the hole pattern. Instead, the guide supports that correspond to the formation of the holes are formed by simple processes and an easy plating process for pattern control such that the holes of the insulation layer may be realized to minute sizes and having a suitable aspect ratio. Therefore, an FED of an improved quality may be realized.

FIGS. 2A through 2H are partially enlarged sectional views of a triode FED as it undergoes sequential processes in a manufacturing method according to a second preferred embodiment of the present invention. The drawings show the FED cut along a long axis direction. The second preferred embodiment differs from the first preferred embodiment of the present invention mainly in the formation of guide supports.

Figure 2A:
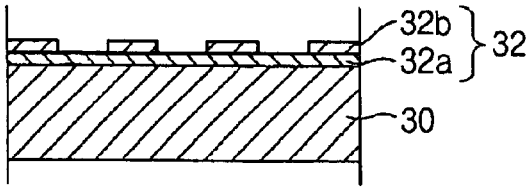
FIGS. 2A–2H show partially enlarged sectional views of a FED as it undergoes sequential processes in a manufacturing method according to a second preferred embodiment of the present invention.

First, with reference to FIG. 2A, a plurality of cathode electrodes 32 are formed in a stripe pattern on a first substrate (hereinafter referred to as a lower substrate) 30. In the second preferred embodiment of the present invention, the cathode electrodes 32 are realized by sequentially depositing an ITO layer 32*a* and chrome elements 32*b* in a predetermined pattern.

Figure 2B:
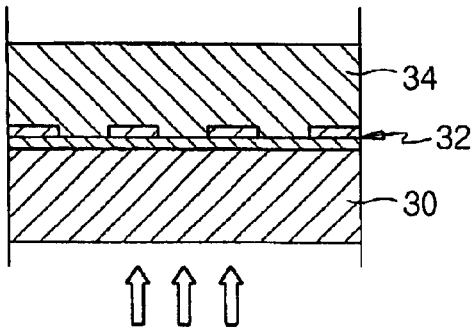

Next, to form guide supports, a photosensitive material 34 is deposited on the lower substrate 30 covering the cathode electrodes 32 (as in the first preferred embodiment) as shown in FIG. 2B. It is preferable that the materials are as described with reference to the first preferred embodiment. A DFR film is also used for the photosensitive material 34 in the second preferred embodiment of the present invention. A thickness of the photosensitive material 34 is either the same as or greater than a thickness of an insulation layer 40 (see FIG. 2F), which will be described below.

In this state, the photosensitive material 34 is patterned to form guide supports. In the second preferred embodiment of the present invention, a photolithography process is used for the purpose of forming the guide supports. That is, the photosensitive material 34 is exposed and developed to realized a predetermined pattern of the photosensitive material 34. At this time, exposure is performed by irradiating a predetermined light from a light source onto the photosensitive material 34 toward either a front surface of the lower substrate 30 on which the cathode electrodes 32 are formed or a rear surface of the lower substrate 30 opposite the surface on which the cathode electrodes 32 are formed. In the second preferred embodiment of the present invention, exposure is performed by irradiating the light to the rear of the lower substrate 30 as shown by the arrows in FIG. 2B. During exposure, the chrome elements 32*b* of the cathode electrodes 32 act as a mask for patterning the photosensitive material 34.

Figure 2C:
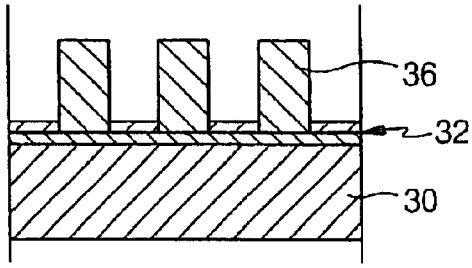

After exposure, developing of the photosensitive material 34 is performed such that guide supports 36 of a predetermined height and width for the formation of insulation layer holes are formed between the chrome elements 32*b* of the cathode electrodes 32, that is, in the area where an electron emitting layer is provided. The end result of this process is shown in FIG. 2C.

Figure 2D:
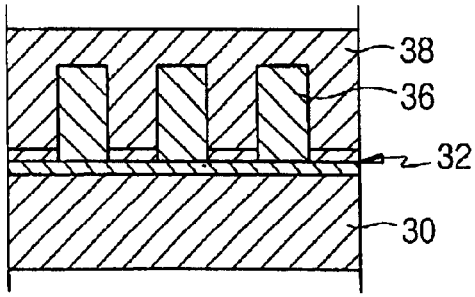
Figure 2E:
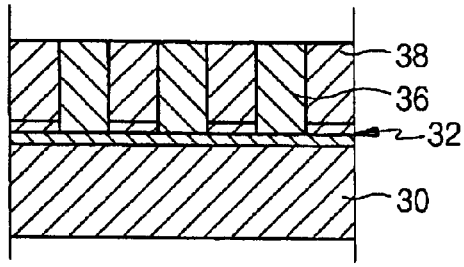
Figure 2F:
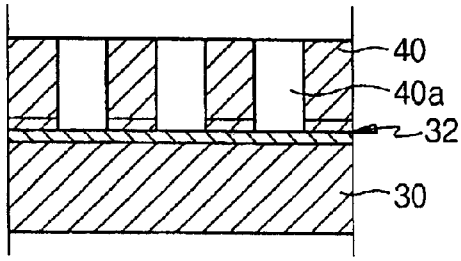

Next, as in the first preferred embodiment of the present invention, a preliminary insulation layer 38 is formed on the lower substrate 30 as shown in FIG. 2D, an upper portion of the preliminary insulation layer 30 is removed such that upper ends of the guide supports 36 are exposed as shown in FIG. 2E, then the guide supports 36 are removed from the lower substrate 30 such that a plurality of holes 40*a* are formed in the preliminary insulation layer 38 to thereby realize a completed insulation layer 40 having the holes 40*a* as shown in FIG. 2F.

Since the formation of the preliminary insulation layer 38, removal of the upper portion of the preliminary insulation layer 38, and removal of the guide supports 36 are realized by processes identical to those used in the first preferred embodiment of the present invention, a detailed description will not be provided. However, it should be noted that that since the guide supports 36 are formed using photosensitive material in the second preferred embodiment of the present invention, a solution used for this purpose is such that it is suitable for the photosensitive material.

Figure 2G:
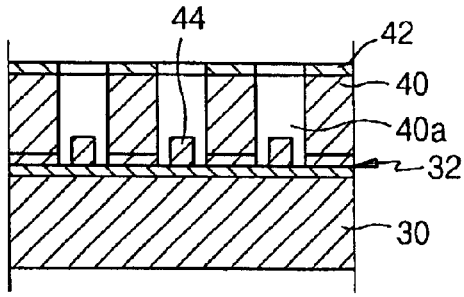
Figure 2H:
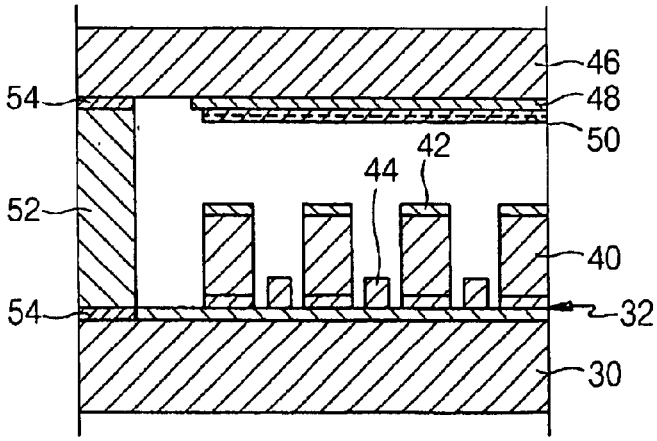

Following the formation of the insulation layer 40 through the processes described above, gate electrodes 42 are formed on the insulation layer 40 using a conventional process, and an electron emitting layer 44 is formed on the cathode electrodes 32 within the holes 40*a* of the insulation layer 40 as shown in FIG. 2G. Next, anode electrodes 48 and a phosphor layer 50 are formed on a second substrate (hereinafter referred to as an upper substrate) 46. A side glass 52 is then interposed between the upper substrate 46 and the lower substrate 30 so as to place the upper substrate 46 and the lower substrate 30 substantially in parallel, after which a sealant 54 is used to fuse the lower substrate 30, the upper substrate 46, and the side glass 52. As a result, a sealed assembly for the FED is realized. Finally, an exhaust unit is used to remove the air from between the substrates 30 and 46 to thereby complete the triode FED as shown in FIG. 2H.

Since the above processes are also identical to those of the first preferred embodiment of the present invention, a detailed description thereof will not be provided. FIGS. 3A through 3L are partially enlarged sectional views of a triode FED as it undergoes sequential processes in a manufacturing method according to a third preferred embodiment of the present invention. The drawings show the FED cut along a long axis direction.

Figure 3A:
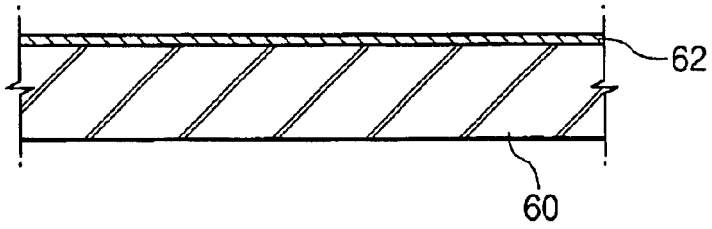
FIGS. 3A–3L show partially enlarged sectional views of a FED as it undergoes sequential processes in a manufacturing method according to a third preferred embodiment of the present invention.

First, with reference to FIG. 3A, a plurality of cathode electrodes 62 are formed in a stripe pattern on a first substrate (hereinafter referred to as a lower substrate) 60.

The cathode electrodes 62 are formed to a thickness of between 1000 and 3000., and are typically made of a metal such as chrome, silver, or nickel, but may also be made of a clear material such as ITO (indium tin oxide). The cathode electrodes 62 are formed using a photolithography process or a thick layer printing process, depending on the material used for the cathode electrodes 62.

Figure 3B:
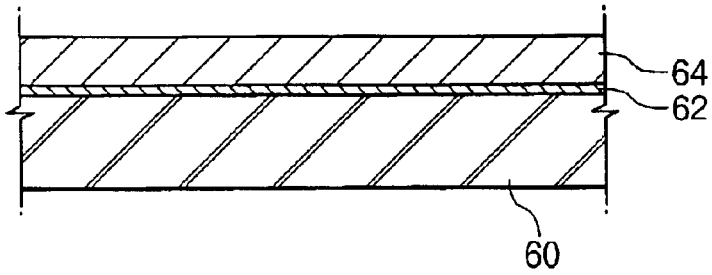
Figure 3C:
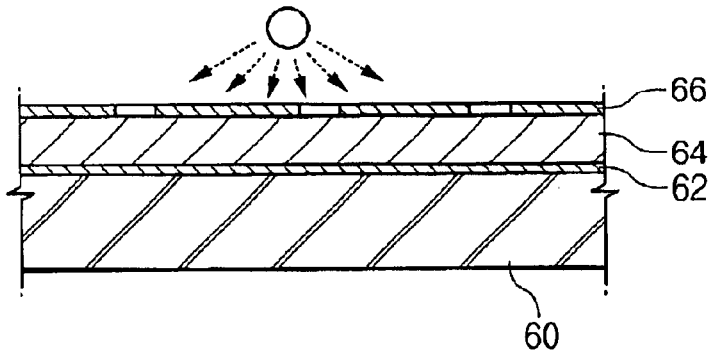
Figure 3D:
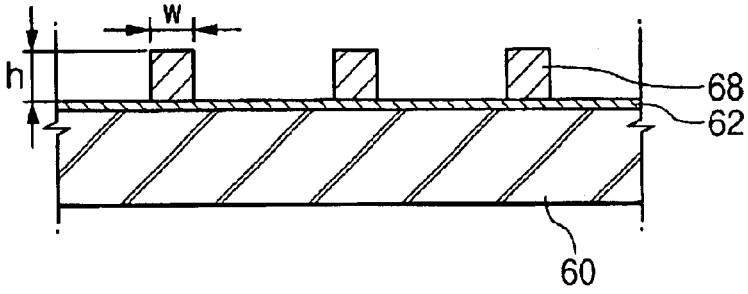

Next, a photosensitive material 64 is deposited on the lower substrate 60 covering the cathode electrodes 62 as shown in FIG. 3B, exposed using a conventional photolithography process and a mask 66 of a predetermined pattern as shown in FIG. 3C, then developed to form photosensitive supports 68 for the formation of holes (this will be described in more detail below) as shown in FIG. 3D.

Exposure of the photosensitive material 64 may be performed by irradiating a predetermined light from a light source onto the photosensitive material 64 toward either a front surface of the lower substrate 60 on which the cathode electrodes 62 are formed as shown by the arrows in FIG. 3C, or a rear surface of the lower substrate 60 opposite the surface on which the cathode electrodes 62 are formed. Also, as shown in FIG. 3D, it is preferable that a height (h) of the photosensitive supports 68 is within the range of 1. m to 20. m, and less than a height of a preliminary insulation layer to be formed hereinafter. It is also preferable for a width of the photosensitive supports 68 to be less than a size of holes to be formed hereinafter.

Figure 3E:
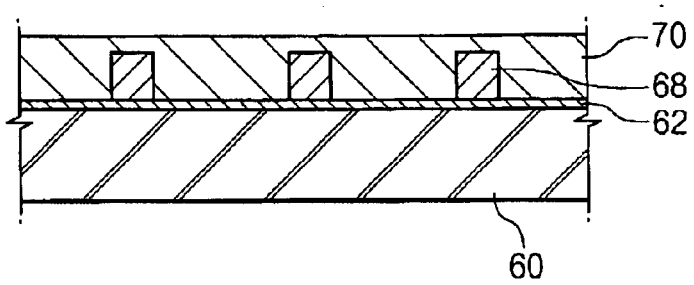

After the formation of the photosensitive supports 68, a preliminary insulation layer 70 is formed on the lower substrate 60 at a thickness sufficient to completely cover the photosensitive supports 68 as shown in FIG. 3E. The preliminary insulation layer 70 may be formed by a conventional printing process, a cataphoresis process, a doctor blade process, or a spray process. The case where the printing process is used to form the preliminary insulation layer 70 will be described as an example.

To form the preliminary insulation layer 70 by a printing process, an insulation paste is first produced. This is accomplished by completely producing a solid vehicle using a solvent such as terpineol, butyl carbitol (BC), and butyl carbitol acetate (BCA) and a binder such as ethyl cellulose (EC) and nitro cellulose (NC). A solvent in which frit and an insulating powder are uniformly mixed is then mixed with the vehicle to complete the insulation paste.

After producing the insulation paste, the paste is provided over an entire upper surface (in the drawing) of the lower substrate 60. It is preferable that the preliminary insulation layer 70 has a height that is approximately double the height (h) of the photosensitive supports 68. This enables the full removal of the insulation material even to a center portion thereof after sintering such that under-cutting is minimized in consideration of etching isotropy.

Next, the preliminary insulation layer 70 is dried for 5–30 minutes at a temperature between 90 and 120,. Following the drying of the preliminary insulation layer 70, a temperature between 350 and 450. is maintained for 10–60 minutes to remove the solvent and binder, after which a temperature that exceeds a softening point of the insulation frit (450–550.) by 20–30, is maintained for 5–60 minutes to sinter the preliminary insulation layer 70. A feature of the third preferred embodiment of the present invention is the automatic removal of the photosensitive supports 68 during the sintering of the preliminary insulation layer 70.

For this purpose, the photosensitive material 64 forming the photosensitive supports 68 may be realized using the materials described in the above preferred embodiments. These photosensitive materials experience abrupt vaporization at a temperature less than or equal to a sintering temperature of the preliminary insulation layer 70, for example, at approximately 350,.

Figure 3F:
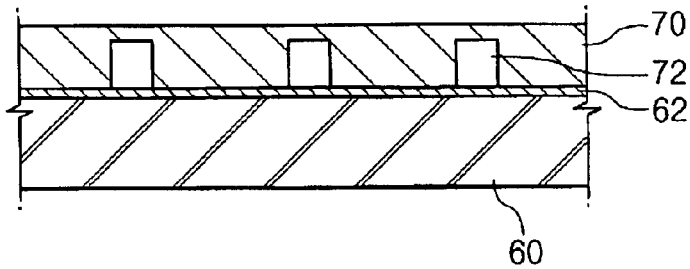
Figure 3G:
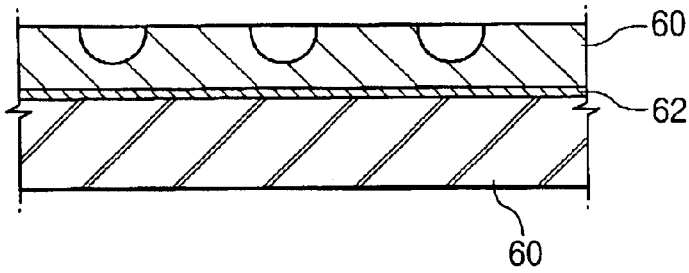
Figure 3H:
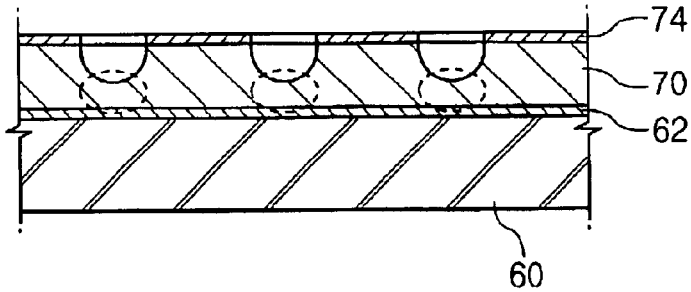

Accordingly, with the vaporization of the photosensitive supports 68, empty spaces 72 are left remaining within the preliminary insulation layer 70 where the photosensitive supports 68 were located as shown in FIG. 3F, or areas of the preliminary insulation layer 70 over where the photosensitive supports 68 were located are depressed toward the empty spaces 72 as shown in FIG. 3G. The latter case of depressions being formed in the preliminary insulation layer 70 will be assumed for the following processes.

Figure 3I:
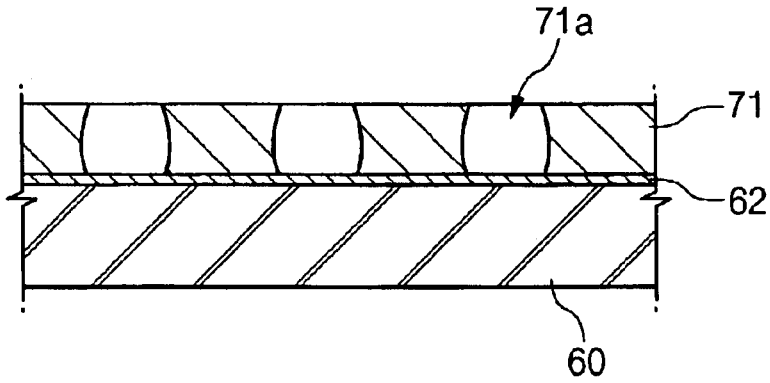

With areas of the preliminary insulation layer 70 depressed as described above, a mask 74 is used and areas of the preliminary insulation layer 70 corresponding to the depressions of the same (shown by the dotted lines in FIG. 3H) are etched to complete the removal of the photosensitive supports 68. As a result, an insulation layer 71 having holes 71*a* where the photosensitive supports 68 were located is realized as shown in FIG. 3I. HF may be used to etch the areas corresponding to the depressions of the preliminary insulation layer 70.

Accordingly, since the holes 71*a* of the insulation layer 71 are formed by etching either portions of the preliminary insulation layer 70 above the empty spaces 72 or areas of the preliminary insulation layer 72 corresponding to the depressions, undercutting of the holes 71*a* is minimized as a result of etching isotropy. Therefore, a cross-section of the holes 71*a* that is nearly vertical (a width of the holes over an entire length from top to bottom) is realized. This enables the formation of the holes 71*a* to a minute size.

Figure 3J:
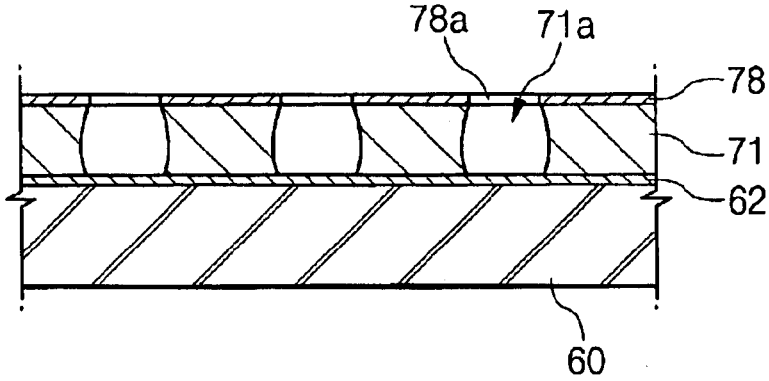

Subsequently, with reference to FIG. 3J, gate electrodes 78 are formed in a stripe pattern on the insulation layer 71 using a conventional thin layer or thick layer process, and gate holes 78*a* are formed in the gate electrodes 78 at areas corresponding to the holes 71*a* of the insulation layer 71 using an etching process. The gate electrodes 78 are provided perpendicularly intersecting the cathode electrodes 62 such that pixel regions are defined by the gate electrodes 78 and the cathode electrodes 62.

Figure 3K:
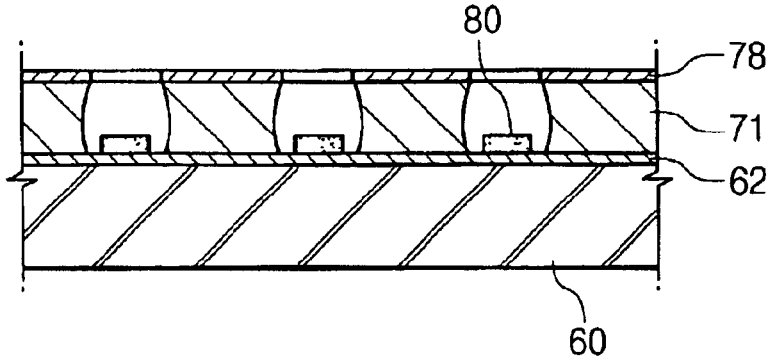

After the formation of the gate electrodes 78, an electron emitting layer 80 is formed on the cathode electrodes 62 within the holes 71*a* of the insulation layer 71 as shown in FIG. 3K. The electron emitting layer 80 may be formed by printing carbonbased material such as carbon nanotubes, graphite, carbon fiber, and diamond-like carbon, and it may also be formed using conical metal tips.

Figure 3L:
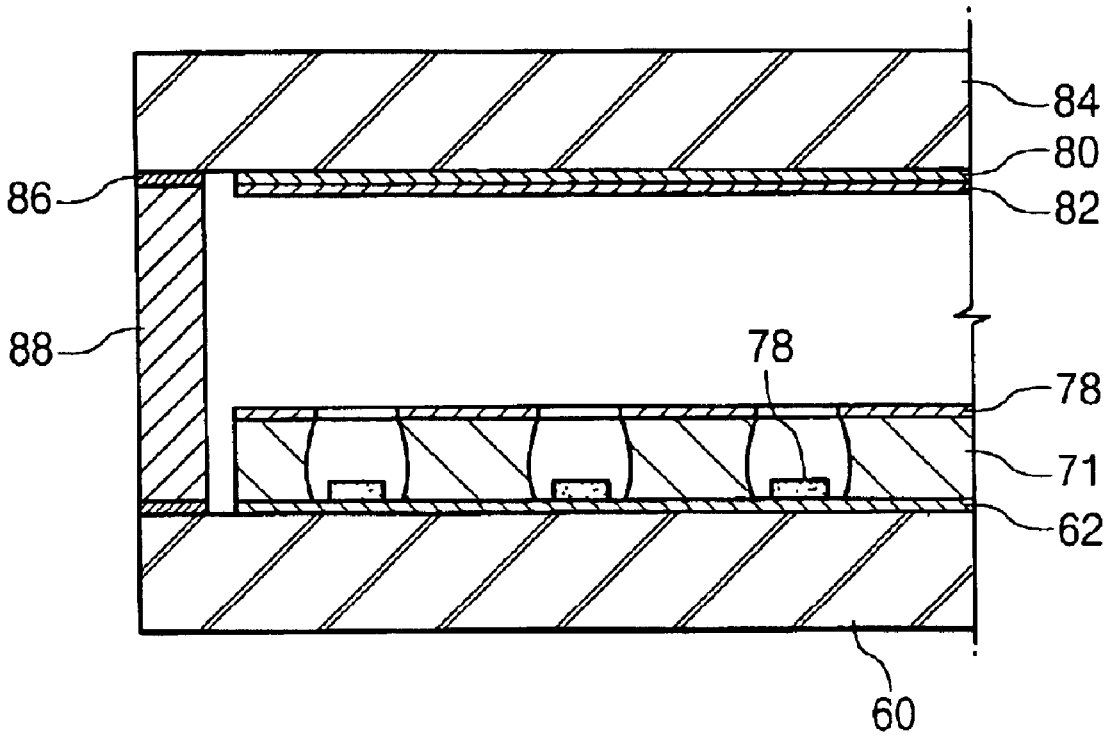

Next, a second substrate (hereinafter referred to as an upper substrate) 84 having anode electrodes 80 and a phosphor layer 82 formed thereon is provided substantially in parallel to the lower substrate 60, then a side glass 86 is interposed between the upper substrate 84 and the lower substrate 60, after which a sealant 88 is used to fuse the lower substrate 60, the upper substrate 84, and the side glass 86. As a result, a sealed assembly for the FED is realized. Finally, an exhaust unit is used to remove the air from between the substrates 60 and 84 to thereby complete the triode FED as shown in FIG. 3L.

In the FED of the present invention manufactured as described above, guide supports are formed using photosensitive material or a plating layer, and the holes of the insulation layer are formed using the guide holes. As a result, the holes are uniformly formed to minute sizes and having a large aspect ratio without having to undergo complicated etching process.

Further, since the holes of the insulation layer are uniform, minute, and have a large aspect ratio, when the electrons are accelerated from the electron emitting layer toward the phosphor layer and through the holes, the amount of electrons leaking between the gate electrodes and the phosphor layer is reduced and the electrons are better accelerated. This results in an exceptional picture quality with high contrast and sharp color separation.

Although preferred embodiments of the present invention have been described in detail hereinabove, it should be clearly understood that many variations and/or modifications of the basic inventive concepts herein taught, which may appear to those skilled in the present art, will still fall within the spirit and scope of the present invention, as defined in the appended claims.

What is claimed is:

1. A method for manufacturing a triode field emission display comprising the steps of:

forming cathode electrodes on a first substrate;

depositing a photosensitive material on the first substrate covering the cathode electrodes;

patterning the photosensitive material in a predetermined pattern to form guide supports for the formation of insulation layer holes at locations where an electron emitting layer will be formed on the cathode electrodes;

forming a preliminary insulation layer on the first substrate covering the guide supports;

removing the guide supports from the cathode electrodes to form holes at the locations of the guide supports, thereby realizing a completed insulation layer from the preliminary insulation layer;

forming gate electrodes on the insulation layer, the gate electrodes having holes corresponding to the holes of the insulation layer;

forming an electron emitting layer on the cathode electrodes;

providing a second substrate with anode electrodes and a phosphor layer formed thereon, substantially in parallel to the first substrate, and connecting and sealing the first and second substrates to realize a sealed assembly; and exhausting air from within the sealed assembly.

2. The method of claim 1, wherein the photosensitive material is selected from the group consisting of a dry film resist film, polyimide, an emulsion, and a photoresist.

3. The method of claim 1, wherein the preliminary insulation layer is formed by using a printing process to deposit and dry an insulation paste on the first substrate covering the guide supports.

4. The method of claim 1, wherein the guide supports for the formation of insulation layer holes are formed by forming holes in the photosensitive material in a predetermined pattern using a photolithography process, and further comprising the steps of:

performing a plating process within the holes to form a plating layer therein, then removing the photosensitive material from the first substrate to thereby realize metal supports by the plating layer.

5. The method of claim 4, wherein the removal of the guide supports is realized by removing an upper portion of the preliminary insulation layer to expose an upper end of the guide supports, and removing the guide supports by using one of a chemical etching process and an electrolysis process.

6. The method of claim 1, wherein the guide supports for the formation of insulation layer holes are formed by patterning the photosensitive material using a photolithography process to thereby realize photosensitive supports obtained by the photosensitive material at locations where an electron emitting layer will be formed.

7. The method of claim 6, wherein exposure performed by the photolithography process is effected from a side of the first substrate opposite that on which the cathode electrodes are formed.

8. The method of claim 6, wherein the removal of the guide supports is realized by sintering the preliminary insulation layer and removing portions of the preliminary insulation layer corresponding to positions of the guide supports.

9. The method of claim 8, wherein the sintering is performed by maintaining a temperature that exceeds a softening point of an insulation frit by 20–30, for 5–60 minutes.

10. The method of claim 1, wherein the preliminary insulation layer is formed by a process selected from the group consisting of a printing process, a cataphoresis process, a doctor blade process, and a spray process.

11. The method of claim 8, wherein removal of the guide supports occurs automatically during sintering of the preliminary insulation layer corresponding to positions of the guide supports.

* * * * *